US005694008A

United States Patent [19]

Hak

[11] Patent Number: 5,694,008

[45] Date of Patent: Dec. 2, 1997

[54] LAMP STARTING APPARATUS FOR LIQUID CRYSTAL PROJECTOR

[75] Inventor: Moon Seong Hak, Seoul, Rep. of Korea

[73] Assignee: LG Electronics, Inc., Seoul, Rep. of Korea

[21] Appl. No.: 413,502

[22] Filed: Mar. 30, 1995

[30] Foreign Application Priority Data

Mar. 30, 1994 [KR] Rep. of Korea ..... 6518/1994

[51] Int. Cl.[6] ..... H05B 31/00

[52] U.S. Cl. ..... 315/289; 315/360; 315/DIG. 5; 315/307

[58] Field of Search ..... 315/DIG. 7, 290, 315/205, 360, 246, 289, 209 R, DIG. 5; 345/52, 211

[56] References Cited

U.S. PATENT DOCUMENTS 4,677,346 6/1987 Roberts et al. ..... 315/226
5,004,953 4/1991 McDonald ..... 315/86

*Primary Examiner*—Paul Gensler
*Assistant Examiner*—Arnold Kinkead
*Attorney, Agent, or Firm*—John P. White

[57] ABSTRACT

A lamp starting apparatus for a liquid crystal projector is disclosed including a lamp for projecting light to a screen, a lamp starting portion for converting an impedance in starting the lamp, and increasing the energy of a starting pulse applied to the lamp, thereby starting the lamp, a lamp driving portion for driving the lamp, and an inverter for driving the lamp according to a signal output from the lamp driving portion, so that the instant lighting and re-lighting of the lamp are enabled to turn on/off the lamp at any time.

20 Claims, 7 Drawing Sheets

F. I G.1
prior art

V t t t
several(KV)

t
several
tens(KV)

LAMP STARTING APPARATUS FOR LIQUID CRYSTAL PROJECTOR

BACKGROUND OF THE INVENTION

The present invention relates to a lamp starting apparatus for a liquid crystal projector, and more particularly, to a lamp starting apparatus for a liquid crystal projector, which facilitates the instant lighting and re-lighting of a lamp.

Generally, a liquid crystal projector is to display an image on a screen according to an input video signal by projecting light from a lamp. Different from televisions, in liquid crystal projectors, instant lighting or re-lighting is not possible.

Specifically, when a liquid crystal projector is turned on/off and power is turned on again, the starting characteristic of the lamp is rendered unstable. In this state, the lamp is not turned on so that an image is not displayed on the screen. If turning-on/off is repeated forcibly, the durability of the lamp is shortened, causing troubles.

A conventional lamp starting apparatus for a liquid crystal projector will be described with reference to FIGS. 1 and 2.

As shown in FIG. 1, the conventional lamp starting apparatus for liquid crystal projector comprises an oscillator 31 for generating a driving pulse, a controller 32 for performing a control according to the driving pulse output from oscillator 31, a driving portion 33 for driving a lamp 35 with the driving pulse supplied from oscillator 31 under the control of controller 32, and a starting portion 34 for starting lamp 35 under the control of controller 32 when an input voltage is fed to lamp 35.

The detailed configuration of the respective components will be discussed below with reference to FIG. 2.

Controller 32 is made up of a condenser C33 charged when a predetermined voltage is applied, resistors R34 and R35 for dividing a voltage, a resistor R33 for determining a charging time constant of condenser C33, a trigger diode D30 which turns on when a voltage is applied via resistors R34 and R35, and a relay 32A having two contacts a and b controlled by trigger diode D30.

Driving portion 33 consists of a driving controller 33A, and an inverter 33B. Inverter 33B has four transistors Q31, Q32, Q33, and Q34 which are switched by the output of driving controller 33A according to the signal fed from oscillator 31.

Starting portion 34 comprises a resistor R31 and condenser 31 forming a charging loop of the lamp's input power source Vd, a thyrister SD31 which turns on when the charge of condenser C31 reaches a predetermined voltage, a low-voltage pulse transformer T31 for generating a pulse when thyrister SD31 is switched, a diode D31 and condenser C32 for rectification on the secondary side of low-voltage pulse transformer T31, an auxiliary discharge tube SG31 which turns on when the voltage rectified by diode D31 and condenser C32 reaches a predetermined voltage, and a high-voltage pulse transformer T32 for applying a high voltage when auxiliary discharge tube SG31 is switched.

The operation of the conventional lamp starting apparatus can be explained as follows.

When the lamp's input power source Vd is fed to starting portion 34, condenser C31 is charged via resistor R31. As the charges of condenser C31 become a break-over voltage of thyrister SD31, thyrister SD31 turns on so that a relatively low rush current is applied to the primary coil of transformer T31. The pulse output from the secondary coil of transformer T31 is rectified by diode D31 and condenser C32.

Here, when the voltage rectified by diode D31 and condenser C32 reaches a predetermined voltage, that is, 3 kv, auxiliary discharge tube SG31 turns on so that a relatively high rush current is applied to the primary coil of transformer T32. When a voltage of many times the predetermined voltage, that is, 15 kv, is generated on the secondary coil of transformer T32, and fed to lamp 35, lamp 35 starts.

When the charges of condenser C31 is discharged, the voltage becomes lower than the break-over voltage of thyrister SD31, turning off thyrister SD31. When charges are re-filled in condenser C31, the above-explained starting operation will be performed repeatedly.

In this situation, because contact b of relay 32A of controller 32 is connected between one end of condenser C31 coupled to the primary coil of transformer T31 of starting portion 34 and one end of transistors Q32 and Q34 of driving portion 33, the starting operation is enabled when contact b of relay 32A of controller 32 is tied.

If contact b of relay 32A is opened, the rush current cannot be supplied to transformer T31 of starting portion 34. Accordingly, a starting pulse cannot be supplied to lamp 35.

Initially, relay 32A of controller 32 is connected to contact b regardless of power-on/off. When a predetermined voltage, that is, 12V is applied, condenser C33 is charged via resistor R33. When the voltage applied through resistors R34 and R35 triggers diode D30, relay 32A is driven so that contact a of relay 32A is connected, and contact b is opened. After a delayed time passes, resistor R33 and condenser C33 stop the operation of starting portion 34 unconditionally.

The driving pulse generated from oscillator 31 is input to driving controller 33A of driving portion 33 via contact a of relay 32A. Driving controller 33A supplies a switching control signal to transistors Q31, Q32, Q33, and Q34 of inverter 33B so that lamp 35 is driven according to the switching operation thereof.

It takes about 4 or 5 seconds to trigger trigger diode D30 of controller 32 after the lamp's input power source Vd is supplied.

In other words, prior to the triggering of trigger diode D30 of controller 32, contact b of relay 32A is tied to perform the starting operation. After four or five seconds, as trigger diode D30 of controller 32 is triggered, contact b of relay 32A is opened to connect contact a. In this condition, the starting operation of lamp 35 stops, and the driving begins to light lamp 35.

The conventional lamp starting apparatus controls the starting operation of lamp 35 by using a small signal of about 12V, which has no relation with the lamp input voltage, and the relay device. For this reason, it takes four or five seconds from starting to driving. Regardless of starting, after a predetermined time, a driving-possible state begins. This raises the failure rate of starting operation, and elongates the starting time excessively. As a result, a small signal circuit may be damaged due to the influence of the starting high-voltage pulse of about 15 kv so that the product itself malfunctions.

SUMMARY OF THE INVENTION

Therefore, it is an object of the present invention to provide a lamp starting apparatus for a liquid crystal projector, which facilitates the starting of a lamp by varying an impedance and increasing the energy of a starting pulse, and detects whether the starting of the lamp is finished or not, to stop the starting of the lamp, for the purpose of reducing the starting failure rate of the lamp.

To accomplish the object of the present invention, there is provided a lamp starting apparatus for a liquid crystal projector is disclosed including a lamp for projecting light to a screen, a lamp starting portion for converting an impedance in starting the lamp, and increasing the energy of a starting pulse applied to the lamp, thereby starting the lamp, a lamp driving portion for driving the lamp, and an inverter for driving the lamp according to a signal output from the lamp driving portion.

BRIEF DESCRIPTION OF THE ATTACHED DRAWINGS

Figure 1:
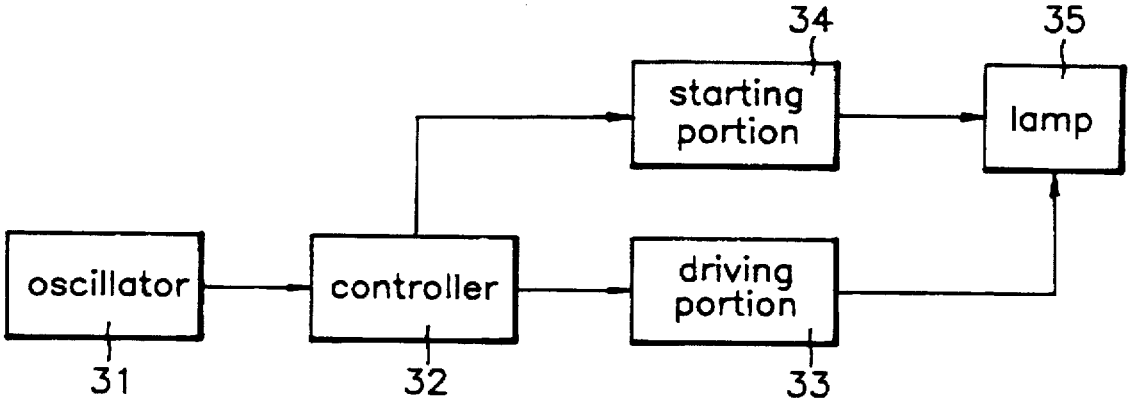
FIG. 1 is a block diagram of a conventional lamp starting apparatus for a liquid crystal projector.
Figure 2:
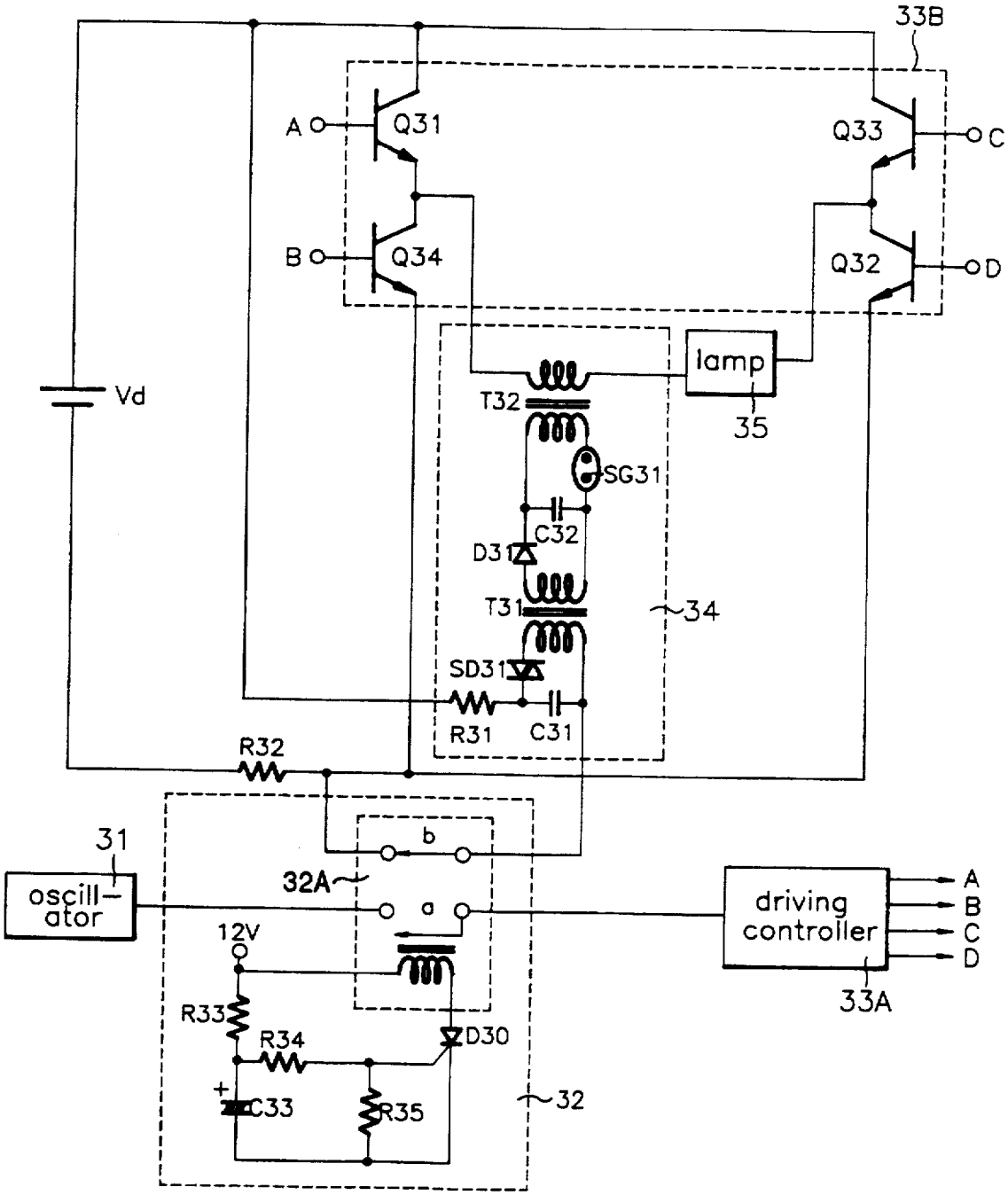
F I G.2 prior art
FIG. 2 is a detailed block diagram of the conventional lamp starting apparatus for a liquid crystal projector.
Figure 3:
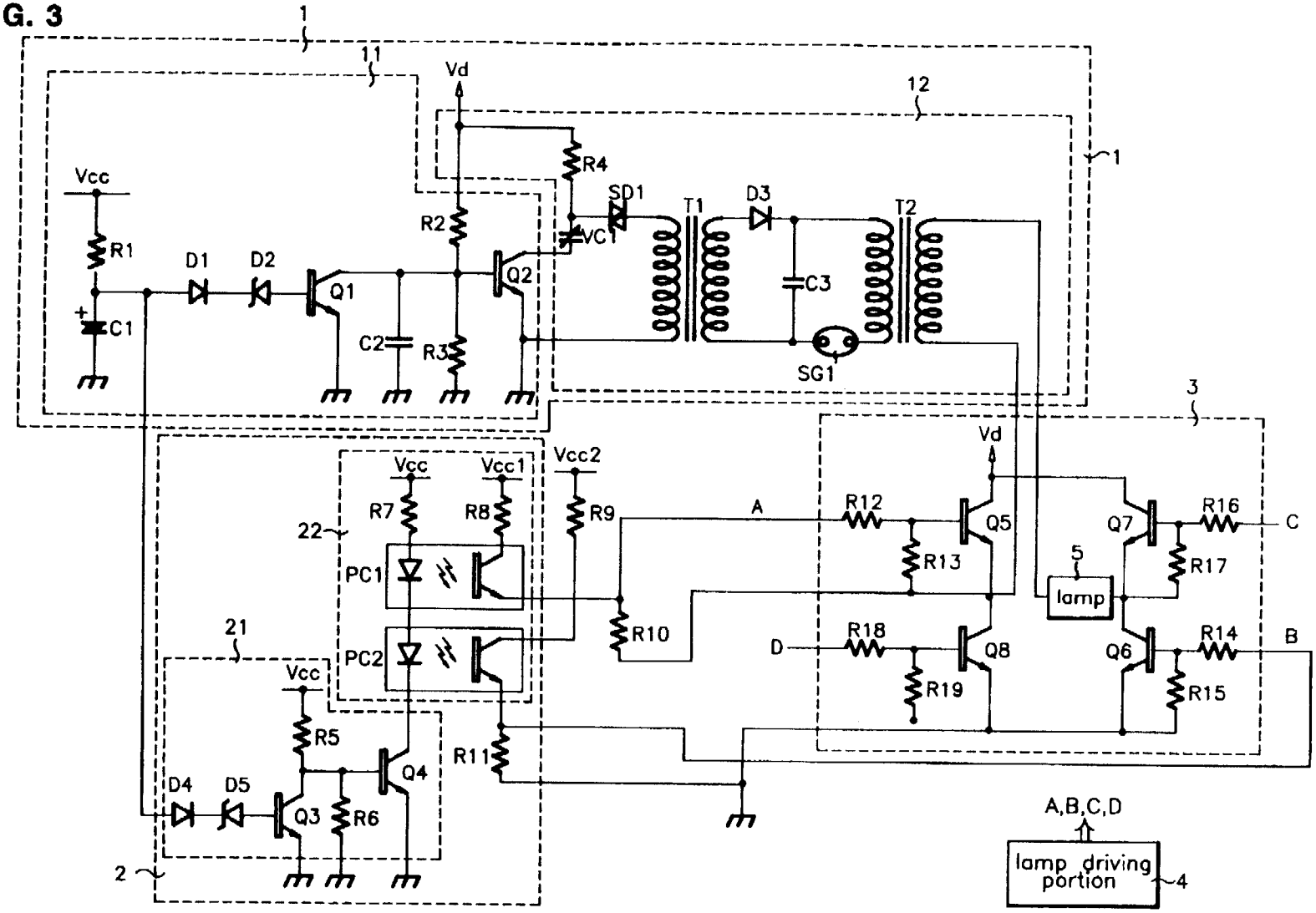
FIG. 3 is a block diagram of a lamp starting apparatus of the present invention.
Figure 6:
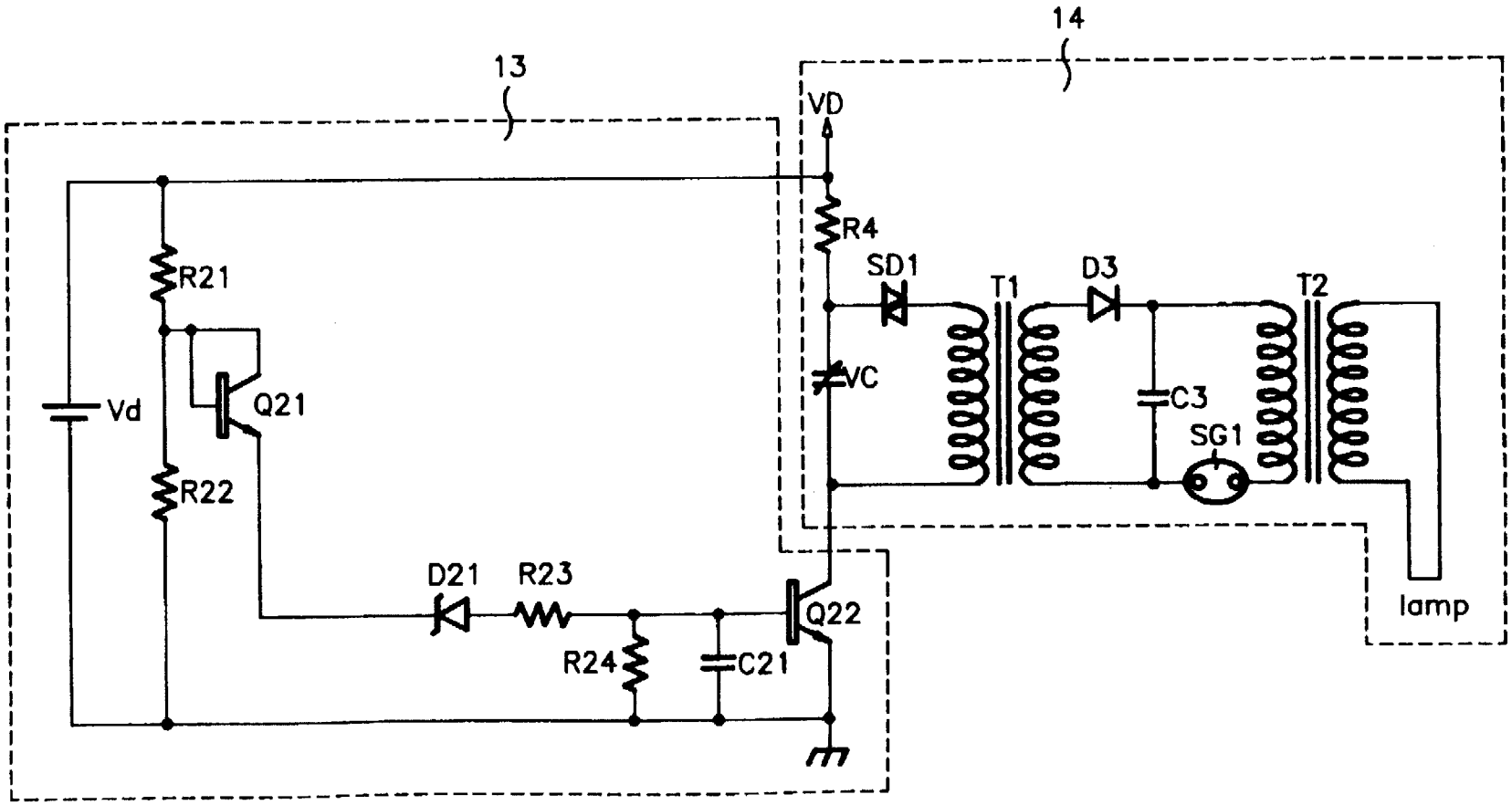
Figure 7:
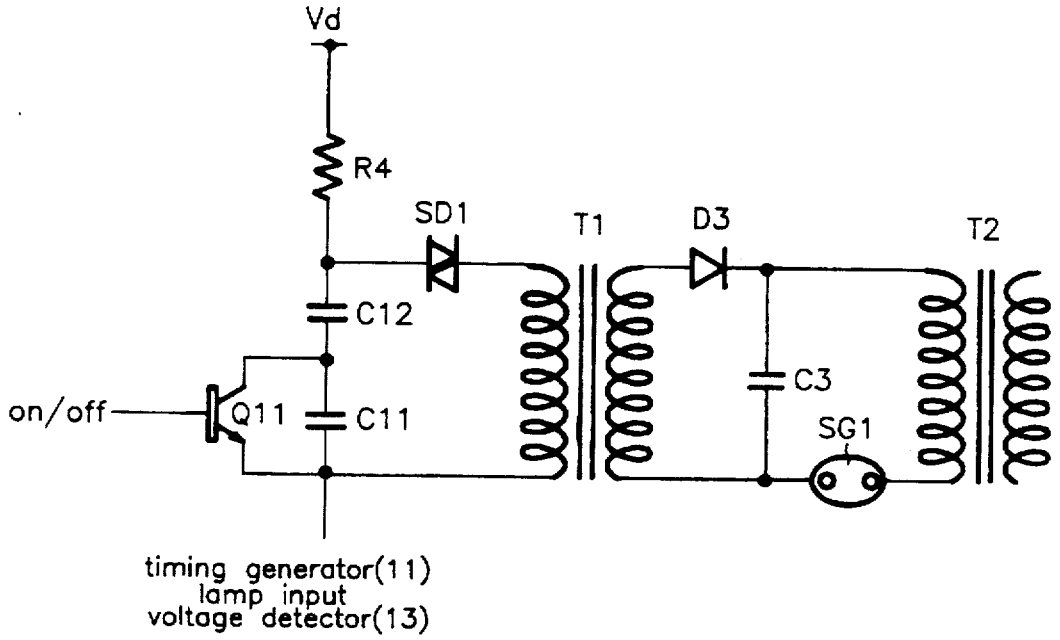
Figure 8:
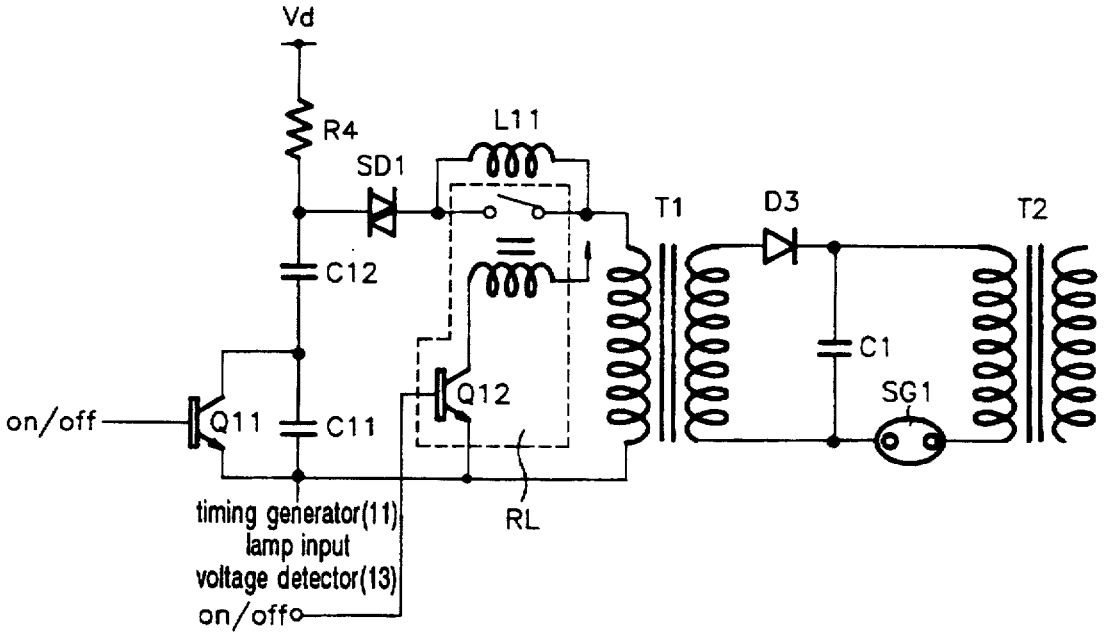

FIGS. 5A and 5B1, 5B2 are waveform diagrams present at the starting/impedance converter of FIG. 3;

FIG. 6 is a diagram of another embodiment of the lamp starting portion of FIGS. 3 and 6;

FIG. 7 is a diagram of another embodiment of the starting/impedance converter of FIGS. 3; and FIG. 8 is a diagram of still another embodiment of the starting/impedance converter of FIGS. 3 and 7.

DETAILED DESCRIPTION OF THE INVENTION

Hereinafter, a preferred embodiment of the present invention will be described with reference to the attached drawings.

Referring to FIG. 3, a lamp starting apparatus for a liquid crystal projector of the present invention comprises a lamp 5, a lamp starting portion 1, a lamp driving portion 4, an inverter 3, and a DC starting controller 2.

Lamp 5 performs the function of a light source for supplying light to the liquid crystal projector, by projecting light to a screen.

Lamp starting portion 1 consists of a timing generator 11 for generating a timing signal when lamp 5 starts, and a starting/impedance converter 12 for converting the impedance according to the timing signal output from timing generator 11 and supplying an increased-energy starting pulse to lamp 5. The lamp starting portion converts the impedance in starting lamp 5, and increases the energy of the starting pulse applied to lamp 5, thereby starting lamp 5.

Here, timing generator 11 comprises a resistor R1 whose one end is connected to a power Vcc, a condenser C1 tied to the other end of resistor R1 and to the ground, a diode D1 whose anode is tied to the other end of resistor R1, a zener diode D2 whose anode is coupled to the cathode of diode D1, a transistor Q1 whose base is connected to the cathode of zener diode D2 and whose emitter is coupled to the ground, a condenser C2 tied to the collector of transistor Q1 and the ground, a resistor R3 coupled to the collector of transistor Q1 and the ground, a resistor R2 connected to a lamp input power source Vd and the collector of transistor Q1, and a transistor Q2 whose base is tied to the collector of transistor Q1, whose emitter is coupled to the ground, and whose collector is connected to the starting/impedance converter 12.

Starting/impedance converter 12 comprises a variable condenser VC whose one end is connected to the collector of transistor Q2 of timing generator 11 to vary the impedance and increase the magnitude and the number of starting pulse, a resistor R4 connected to lamp input power source Vd and the other end of variable condenser VC to determine the charging time constant of variable condenser VC, a bidirectional thyrister SD1 tied to the other end of variable condenser VC, a transformer T1 whose primary coil is coupled to bidirectional thyrister SD1 and for generating a starting pulse varied by variable condenser VC, diode D3 and condenser C3 connected to the secondary coil of transformer T1 and for performing rectification, an auxiliary discharge tube SG1 for turning on when the voltage rectified by diode D3 and condenser C3 reaches a predetermined voltage, and a transformer T2 for supplying a starting pulse energy-increased in switching auxiliary discharge tube SG1 to lamp 5.

Lamp driving portion 4 outputs a signal for driving the lamp to inverter 3.

Inverter 3 is made up of four transistors Q5, Q6, Q7, and Q8 connected to lamp driving portion 4 and operating in push-pull to drive lamp 5. The inverter drives lamp 5 according to the signal output from lamp driving portion 4.

DC starting controller 2 supplies a DC power to lamp 5 via inverter 3 for the purpose of starting lamp 5. This controller is designed to prevent the starting failure of lamp 5 and to thereby perform a perfect starting of the lamp.

Here, DC starting controller 3 has a timing generator 21 for generating a timing signal at the starting of lamp 5, and a lamp DC supply controller 22 switched according to the signal output from timing generator 21 and controlling the supply of DC power to lamp 5 via inverter 3.

Timing generator 21 comprises a diode D4 whose anode is tied to resistor R1 and condenser C1 of timing generator 11 connected to power Vcc and for performing a charging/discharging function, a zener diode D5 whose anode is tied to the cathode of diode D4, a transistor Q3 whose base is connected to the cathode of zener diode D5, whose emitter is tied to the ground, and Whose collector is coupled to power VCC via resistor R5, a resistor R6 tied to the collector of transistor Q3 and the ground, and a transistor Q4 whose base is tied to the collector of transistor Q3, whose emitter is coupled to the ground, and whose collector is tied to lamp DC supply controller 22.

Lamp DC supply controller 22 is made up of a photocoupler PC1 whose light-emitting portion is coupled to power Vcc, and whose light-receiving portion is tied to one input port A of inverter 3, and a photocoupler PC2 whose light-emitting portion is tied in series to the light-emitting portion of photocoupler PC1 and the collector of transistor Q4 of timing generator 21, and whose light-receiving portion is tied to the other input port B of inverter 3.

The operation of the lamp starting apparatus of the present invention will be explained with reference to FIGS. 4A through 5B.

Figures 4A, 4B, 4C, 4D, 4E, 4F, 4G, 4H:
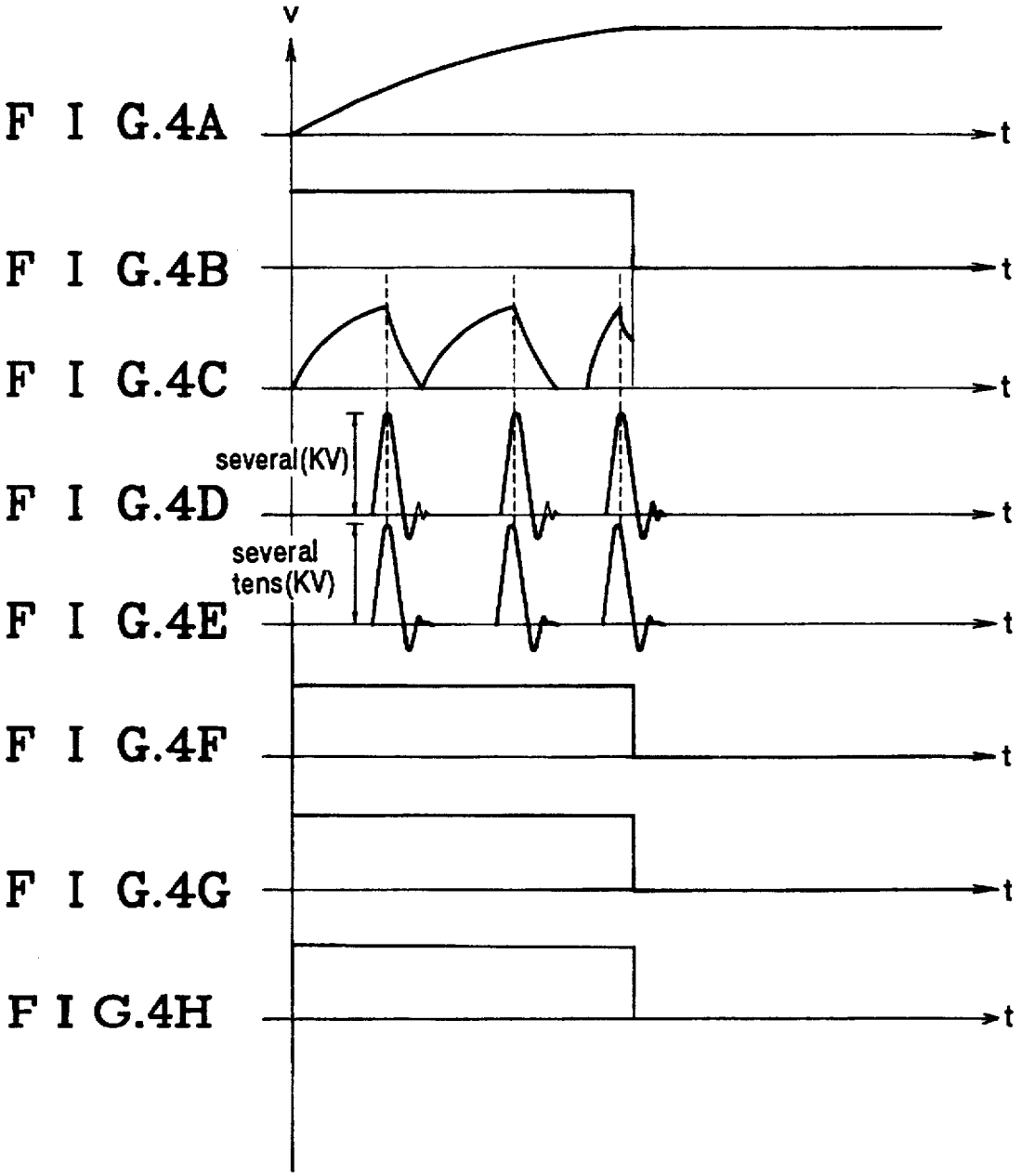
FIGS. 4A–4H are waveform diagrams present at respective components shown in FIG. 3.

When power Vcc is applied to timing generator 11, condenser C1 is charged via resistor R1, and the power is applied to zener diode D2 via diode D1. As shown in FIG. 4A, this voltage turns on zener diode D2 after a predetermined time, that is, after about 1–3 seconds until it reaches the break-over voltage of zener diode D2. While zener diode D2 is turned off, that is, for 1–3 seconds, transistor Q1 is turned off to exhibit a HIGH level, and transistor Q2 is turned on.

Variable condenser VC charges or discharges lamp input power source Vd input according to the charging time constant of resistor R4, as shown in FIG. 4C, and triggers bidirectional thyrister SD1. The power is supplied to the primary coil of transistor T1 so that a starting pulse whose peak is several kilovolts is output via the secondary coil, as shown in FIG. 4D. The starting pulse output from the secondary coil of transistor T1 is rectified by diode D3 and condenser C3, and turns on auxiliary discharge tube SG1 when the voltage of the rectified starting pulse reaches a predetermined level. By doing so, a relatively high current is applied to the primary coil of transistor T2. To the secondary coil of transistor T2, the starting pulse whose peak is tens of kilovolts is output to start lamp 5, as shown in FIG. 4E.

Here, the charging/discharging is performed by varying the impedance of variable condenser VC, and the magnitude or the number of starting pulse shown in FIGS. 4D and 4E is increased to supply a lot of energy to transformer T2. This operation facilitates the starting of lamp 5.

Figure 5A:
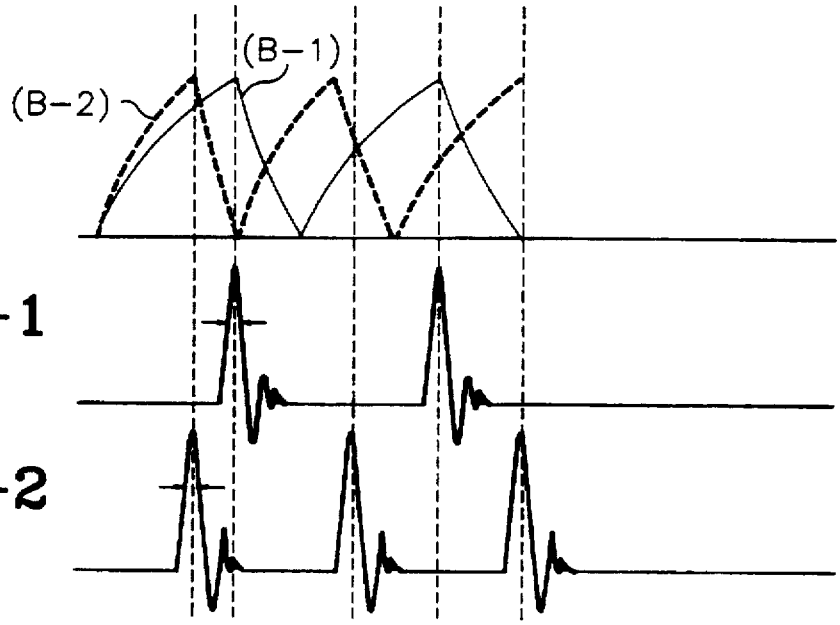

More specifically, when the signal applied by variable condenser VC is varied as shown in FIG. 5A, the magnitude and number of the pulse becomes larger than that of FIG. 5B-1. For this reason, a lot of energy can be supplied to transformer T2, as shown in FIG. 5B-2.

More energy is applied to lamp 5 to attain a perfect starting.

For more accurate starting of lamp, DC starting controller 2 can be additionally driven. The operation of the controller will be explained below.

When power Vcc is applied, condenser Cl is charged via resistor R1 of timing generator 11. The power is then applied to zener diode D5 via diode D4. As shown in FIG. 4A, this voltage turns on zener diode D5 after a predetermined time, that is, after about 1–3 seconds until it reaches the break-over voltage of zener diode D5. While zener diode D5 is turned off, that is, for 1–3 seconds, transistor Q3 is turned off to exhibit a HIGH level as shown in FIG. 4F, and transistor Q3 is turned on to show a LOW level.

While transistor Q3 is turned off, a HIGH level signal is applied to the base of transistor Q4 to turn on transistor Q4 and photocouplers PC1 and PC2 of lamp DC supply controller 22. In this situation, transistors Q5 and Q6 of inverter 3 are turned on, to supply DC power to lamp 5. The DC power starts lamp 5.

In other words, only transistors Q5 and Q6 are turned on for a predetermined time, that is, for the starting time of 1–3 seconds, and other transistors Q7 and Q8 are turned off for the starting time so that DC power is applied to lamp 5 to start it.

In driving after the starting, transistors Q5 and Q6 and transistors Q7 and Q8 are alternately turned on/off by signals A, B, C and D applied from lamp driving portion 4 to inverter 3, to AC drive lamp 5.

Lamp 5 is in a nonconducting state. However, when a pulse for starting is applied thereto, a path is formed between electrodes due to electron emission, to make the lamp conductive. If DC power is supplied, a lot of thermions are emitted so that a great volume of energy is shifted to the center to easily form the path. This makes the starting easy.

Another embodiment of lamp starting portion 1 of the lamp starting apparatus of the present invention, as shown in FIG. 6, comprises a lamp input voltage detector 13 for detecting the input voltage of lamp 5 to indicate whether lamp 5 starts or not, and a starting/impedance converter 14 for converting the impedance according to the signal output from lamp input voltage detector 13 and supplying an increased-energy starting pulse to lamp 5.

In starting lamp 5, about 300V of lamp input power is applied to lamp 5. When the starting is finished and lamp 5 is driven, the lamp input voltage drops sharply. It is therefore known whether lamp 5 is driven or not by detecting the voltage of lamp 5. When it is detected whether the starting of lamp 5 is finished or not, that is, a time point at which the lamp input voltage drops drastically, and the starting pulse is applied to the lamp until the starting is finished, that is, until the lamp input voltage drops, a more perfect starting of lamp is enabled.

Here, starting/impedance converter 14 is configured in the same manner as that of starting/impedance converter 12 of the lamp starting portion of FIG. 3. Lamp input voltage detector 13 comprises resistors R21 and R22 connected in series to lamp input power source Vd and for performing voltage division, a transistor Q21 for converting the impedance of the voltage divided by resistors R21 and R22, a zener diode D21 whose cathode is tied to the emitter of transistor Q21, a resistor R23 whose one end is connected to the anode of zener diode D21, a resistor R24 connected to the other end of resistor R23 and the ground, a condenser C21 tied in parallel to resistor R24, and a transistor Q22 whose base is connected to the other end of resistor R23, whose emitter is coupled to the ground, and whose collector is connected to variable condenser VC of starting/impedance converter 14.

The operation of lamp input voltage detector 13 and starting/impedance converter 14 will be described below.

When lamp input voltage is applied to lamp input voltage detector 13, lamp input power source Vd is divided by resistors R21 and R22, and impedance-converted by impedance-converting transistor Q21. The converted voltage is supplied to zener diode D21.

Zener diode D21 is turned on. The voltage applied when zener diode D21 is turned on drops by resistors R23 and R24, to turn on transistor Q22 and operate starting/impedance converter 14.

Variable condenser VC charges or discharges lamp input power source Vd input according to the charging time constant of resistor R4, as shown in FIG. 4C, and triggers bidirectional thyrister SD1. The power is supplied to the primary coil of transistor T1 so that a starting pulse whose peak is several kilovolts is output via the secondary coil, as shown in FIG. 4D. The starting pulse output from the secondary coil of transistor T1 is rectified by diode D3 and condenser C3, and turns on auxiliary discharge tube SG1 when the voltage of the rectified starting pulse reaches a predetermined level. By doing so, a relatively high current is applied to the primary coil of transistor T2. To the secondary coil of transistor T2, the starting pulse whose peak is tens of kilovolts is output to start lamp 5, as shown in FIG. 4E.

Here, the charging/discharging is performed by varying the impedance of variable condenser VC, and the magnitude or the number of starting pulse shown in FIGS. 4D and 4E is increased to supply a lot of energy to transformer T2. This operation facilitates the starting of lamp 5.

More specifically, when the signal applied by variable condenser VC is varied as shown in FIG. 5A, the magnitude and number of the pulse becomes larger than that of FIG. 5B-1. For this reason, a lot of energy can be supplied to transformer T2, as shown in FIG. 5B-2.

Just after successful starting of lamp 5, lamp 5 acts as a load so that the voltage of lamp input power source Vd drops by 20–30V due to the negative load characteristic.

When lamp 5 starts, the voltage of lamp input power source Vd decreases and the voltage divided by resistors R21 and R22 of lamp input voltage detector 13 also decreases, to thereby turn off zener diode D21. Accordingly, transistor Q22 is turned off and starting/impedance converter 14 does not operate to stop the starting operation for generating a starting pulse.

Another embodiment of starting/impedance converter 12 or 14 of the present invention, as shown in FIG. 7, comprises a condenser C11 whose one end is connected to timing generator 11, or lamp input voltage detector 13, a condenser C12 whose one end is tied to the other end of condenser 11, a transistor Q11 whose collector and emitter are connected to either end of condenser C11 and switched according to an externally input signal, a resistor R4 connected to lamp input power source Vd and the other end of condenser C12 and for determining the charging time constant of condensers C11 and C12, a bidirectional thyrister SD1 whose one end is tied to the other end of condenser C12, a transformer T1 whose primary coil is connected to bidirectional thyrister SD1 and for generating a starting pulse converted by condensers C11 and C12, diode D3 and condenser C3 tied to the secondary coil of transformer T1 and for performing rectification, an auxiliary discharge tube SG1 which turns on when the voltage rectified by diode D3 and condenser C3 reaches a predetermined voltage, and a transformer T2 for supplying a starting pulse energy-increased in switching auxiliary discharge tube SG1 to lamp 5.

In other words, the second embodiment of the starting/impedance converter 12 or 14 of the present invention controls the charging operation of condenser C11 by using two condensers C11 and C12 and transistor Q11. These act as a variable condenser, increasing the magnitude and number of starting pulse.

According to an externally input control signal, transistor Q11 is turned on/off to vary the impedance of condensers C11 and C12. This also varies the magnitude and number of pulse, facilitating the starting of lamp.

Still another embodiment of starting/impedance converter 12 or 14 of the present invention, as shown in FIG. 8, comprises a condenser C11 whose one end is connected to timing generator 11, or lamp input voltage detector 13, a condenser C12 whose one end is tied to the other end of condenser 11, a resistor R4 connected to lamp input power source Vd and the other end of condenser C12 and for determining the charging time constant of condensers C11 and C12, a transistor Q11 whose collector and emitter are connected to either end of condenser C11 and switched according to an externally input signal, a bidirectional thyrister SD1 whose one end is tied to the other end of condenser C12, a coil L11 whose one end is connected to the other end of bidirectional thyrister SD1, a relay RL tied to either end of coil L11 and switched according to an externally input control signal, a transformer T1 whose primary coil is connected to the other end of coil L11 and for generating a starting pulse converted by condensers C11 and C12 and coil L11, diode D3 and condenser C3 tied to the secondary coil of transformer T1 and for performing rectification, an auxiliary discharge tube SG1 which turns on when the voltage rectified by diode D3 and condenser C3 reaches a predetermined voltage, and a transformer T2 for supplying a starting pulse energy-increased in switching auxiliary discharge tube SG1.

In other words, the third embodiment of the starting/impedance converter 12 or 14 of the present invention increases the magnitude and number of starting pulse by using two condensers C11 and C12, transistor Q11, coil L11, and relay RL.

According to an externally input control signal, transistor Q11 and relay RL are turned on/off so that the magnitude and number of pulse is increased according to the impedance of condensers C11 and C12 and coil L11, facilitating the starting of lamp.

As described above, in this invention, the instant lighting and re-lighting of a lamp are enabled to turn on/off the lamp at any time like a television. In addition, the blackening of the lamp due to the failure of starting is prevented to elongate the durability of lamp.

What is claimed is:

1. A lamp starting apparatus for a liquid crystal projector comprising:

a lamp for projecting light to a screen;

a timing generator for generating a timing signal to start said lamp; and a starting and impedance converter for converting the impedance according to the timing signal output from said timing generator and supplying an increased-energy starting pulse to said lamp, wherein the number of pulses generated by the starting and impedance converter increases during continuous restart of the lamp within a set period of time.

2. A lamp starting apparatus for a liquid crystal projector as claimed in claim 1, further comprising a DC starting controller for supplying a direct current to said lamp.

3. A lamp starting apparatus for a liquid crystal projector as claimed in claim 2, wherein said DC starting controller β comprises:

a timing generator for generating a timing signal at the starting of said lamp; and a lamp DC supply controller switched according to a signal output from said timing generator and controlling the supply of DC power to said lamp.

4. A lamp starting apparatus for a liquid crystal projector as claimed in claim 3, wherein said lamp DC supply controller comprises:

a first photocoupler whose light-emitting portion is coupled to a power source, and whose light-receiving portion is tied to one input port of an inverter; and a second photocoupler whose light-emitting portion is tied in series to the light-emitting portion of said first photocoupler, and whose light-receiving portion is tied to the other input port of said inverter.

5. A lamp starting apparatus for a liquid crystal projector as claimed in claim 1, wherein said starting/impedance converter comprises:

a variable condenser whose one end is connected to one end of said timing generator to vary an impedance and increase the magnitude and number of starting pulse;

a resistor connected to said lamp input power source and the other end of said variable condenser to determine a charging time constant of said variable condenser;

a bidirectional thyrister whose one end is tied to the other end of said variable condenser;

a first transformer whose primary coil is coupled to said bidirectional thyrister and for generating a starting pulse varied by said variable condenser;

a diode and condenser connected to the secondary coil of said transformer and for performing rectification;

an auxiliary discharge tube for turning on when the voltage rectified by said diode and condenser reaches a predetermined voltage; and a second transformer for supplying a starting pulse energy-increased in switching said auxiliary discharge tube to said lamp.

6. A lamp starting apparatus for a liquid crystal projector as claimed in claim 1, wherein said starting and impedance converter comprises:

a first condenser whose one end is connected to said timing generator;

a second condenser whose one end is tied to the other end of said first condenser;

a transistor whose collector and emitter are connected to either end of said first condenser and switched according to an externally input signal;

a resistor connected to said lamp input power source and the other end of said second condenser and for determining the charging time constant of said first and second condensers;

a bidirectional thyrister whose one end is tied to the other end of said second condenser;

a first transformer whose primary coil is connected to said bidirectional thyrister and for generating a starting pulse converted by said first and second condensers;

a diode and third condenser tied to the secondary coil of said first transformer and for performing rectification;

an auxiliary discharge tube which turns on when the voltage rectified by said diode and third condenser reaches a predetermined voltage; and a second transformer for supplying a starting pulse energy-increased in switching said auxiliary discharge tube to said lamp.

7. A lamp starting apparatus for a liquid crystal projector as claimed in claim 1, wherein said starting and impedance converter comprises:

a first condenser whose one end is connected to said timing generator;

a second condenser whose one end is tied to the other end of said first condenser;

a transistor whose collector and emitter are connected to either end of said first condenser and switched according to an externally input signal;

a resistor connected to said lamp input power source and the other end of said second condenser and for determining the charging time constant of said first and second condensers;

a bidirectional thyrister whose one end is tied to the other end of said second condenser;

a coil whose one end is connected to the other end of said bidirectional thyrister;

a relay tied to either end of said coil and switched according to an externally input control signal;

a first transformer whose primary coil is connected to the other end of said coil and for generating a starting pulse converted by said first and second condensers and coil;

a diode and third condenser tied to the secondary coil of said first transformer and for performing rectification;

an auxiliary discharge tube which turns on when the voltage rectified by said diode and third condenser reaches a predetermined voltage; and a second transformer for supplying a starting pulse energy-increased in switching said auxiliary discharge tube.

8. A lamp starting apparatus for a liquid crystal projector as claimed in claim 2, wherein said starting and impedance converter comprises:

a variable condenser whose one end is connected to one end of said timing generator to vary an impedance and increase the magnitude and number of starting pulses;

a resistor connected to said lamp input power source and the other end of said variable condenser to determine a charging time constant of said variable condenser;

a bidirectional thyrister whose one end is tied to the other end of said variable condenser;

a first transformer whose primary coil is coupled to said bidirectional thyrister and for generating a starting pulse varied by said variable condenser;

a diode and condenser connected to the secondary coil of said transformer and for performing rectification;

an auxiliary discharge tube for turning on when the voltage rectified by said diode and condenser reaches a predetermined voltage; and a second transformer for supplying a starting pulse energy-increased in switching said auxiliary discharge tube to said lamp.

9. A lamp starting apparatus for a liquid crystal projector as claimed in claim 2, wherein said starting and impedance converter comprises:

a first condenser whose one end is connected to said timing generator;

a second condenser whose one end is tied to the other end of said first condenser;

a transistor whose collector and emitter are connected to either end of said first condenser and switched according to an externally input signal;

a resistor connected to said lamp input power source and the other end of said second condenser and for determining the charging time constant of said first and second condensers;

a bidirectional thyrister whose one end is tied to the other end of said second condenser;

a first transformer whose primary coil is connected to said bidirectional thyrister and for generating a starting pulse converted by said first and second condensers;

a diode and third condenser tied to the secondary coil of said first transformer and for performing rectification;

an auxiliary discharge tube which turns on when the voltage rectified by said diode and third condenser reaches a predetermined voltage; and a second transformer for supplying a starting pulse energy-increased in switching said auxiliary discharge tube to said lamp.

10. A lamp starting apparatus for a liquid crystal projector as claimed in claim 2, wherein said starting and impedance converter comprises:

a first condenser whose one end is connected to said timing generator;

a second condenser whose one end is tied to the other end of said first condenser;

a transistor whose collector and emitter are connected to either end of said first condenser and switched according to an externally input signal;

a resistor connected to said lamp input power source and the other end of said second condenser and for determining the charging time constant of said first and second condensers;

a bidirectional thyrister whose one end is tied to the other end of said second condenser;

a coil whose one end is connected to the other end of said bidirectional thyrister;

a relay tied to either end of said coil and switched according to an externally input control signal;

a first transformer whose primary coil is connected to the other end of said coil and for generating a starting pulse converted by said first and second condensers and coil;

a diode and third condenser tied to the secondary coil of said transformer and for performing rectification;

an auxiliary discharge tube which turns on when the voltage rectified by said diode and third condenser reaches a predetermined voltage; and a second transformer for supplying a starting pulse energy-increased in switching said auxiliary discharge tube.

11. A lamp starting apparatus for a liquid crystal projector as claimed in claim 1, further comprising:

a lamp input voltage detector for detecting the input voltage of said lamp to indicate whether said lamp starts or not.

12. A lamp starting apparatus for a liquid crystal projector as claimed in claim 11, wherein said starting and impedance converter comprises:

a variable condenser whose one end is connected to said lamp input voltage detector to vary an impedance and increase the magnitude and number of starting pulses;

a resistor connected to said lamp input power source and the other end of said variable condenser to determine a charging time constant of said variable condenser;

a bidirectional thyrister whose one end is tied to the other end of said variable condenser;

a first transformer whose primary coil is coupled to said bidirectional thyrister and for generating a starting pulse varied by said variable condenser;

a diode and condenser connected to the secondary coil of said transformer and for performing rectification;

an auxiliary discharge tube for turning on when the voltage rectified by said diode and condenser reaches a predetermined voltage; and a second transformer for supplying a starting pulse energy-increased in switching said auxiliary discharge tube to said lamp.

13. A lamp starting apparatus for a liquid crystal projector as claimed in claim 11, wherein said starting and impedance converter comprises:

a first condenser whose one end is connected to said lamp input voltage detector;

a second condenser whose one end is tied to the other end of said first condenser;

a transistor whose collector and emitter are connected to either end of said first condenser and switched according to an externally input signal;

a resistor connected to said lamp input power source and the other end of said second condenser and for determining the charging time constant of said first and second condensers;

a bidirectional thyrister whose one end is tied to the other end of said second condenser;

a first transformer whose primary coil is connected to said bidirectional thyrister and for generating a starting pulse converted by said first and second condensers;

a diode and third condenser tied to the secondary coil of said first transformer and for performing rectification;

an auxiliary discharge tube which turns on when the voltage rectified by said diode and third condenser reaches a predetermined voltage; and a second transformer for supplying a starting pulse energy-increased in switching said auxiliary discharge tube to said lamp.

14. A lamp starting apparatus for a liquid crystal projector as claimed in claim 11, wherein said starting and impedance converter comprises:

a first condenser whose one end is connected to said lamp input voltage detector;

a second condenser whose one end is tied to the other end of said first condenser;

a transistor whose collector and emitter are connected to either end of said first condenser and switched according to an externally input signal;

a resistor connected to said lamp input power source and the other end of said second condenser and for determining the charging time constant of said first and second condensers;

a bidirectional thyrister whose one end is tied to the other end of said second condenser;

a coil whose one end is connected to the other end of said bidirectional thyrister;

a relay tied to either end of said coil and switched according to an externally input control signal;

a first transformer whose primary coil is connected to the other end of said coil and for generating a starting pulse converted by said first and second condensers and coil;

a diode and third condenser tied to the secondary coil of said transformer and for performing rectification;

an auxiliary discharge tube which turns on when the voltage rectified by said diode and third condenser reaches a predetermined voltage; and a second transformer for supplying a starting pulse energy-increased in switching said auxiliary discharge tube.

15. A lamp starting apparatus for a liquid crystal projector as claimed in claim 2, further comprising:

a lamp input voltage detector for detecting the input voltage of said lamp to indicate whether said lamp starts or not.

16. A lamp starting apparatus for a liquid crystal projector as claimed in claim 15, wherein said starting and impedance converter comprises:

a variable condenser whose one end is connected to said lamp input voltage detector to vary an impedance and increase the magnitude and number of starting pulse;

a resistor connected to said lamp input power source and the other end of said variable condenser to determine a charging time constant of said variable condenser;

a bidirectional thyrister whose one end is tied to the other end of said variable condenser;

a first transformer whose primary coil is coupled to said bidirectional thyrister and for generating a starting pulse varied by said variable condenser;

a diode and condenser connected to the secondary coil of said transformer and for performing rectification;

an auxiliary discharge tube for turning on when the voltage rectified by said diode and condenser reaches a predetermined voltage; and a second transformer for supplying a starting pulse energy-increased in switching said auxiliary discharge tube to said lamp.

17. A lamp starting apparatus for a liquid crystal projector as claimed in claim 15, wherein said starting and impedance converter comprises:

a first condenser whose one end is connected to said lamp input voltage detector;

a second condenser whose one end is tied to the other end of said first condenser;

a transistor whose collector and emitter are connected to either end of said first condenser and switched according to an externally input signal;

a resistor connected to said lamp input power source and the other end of said second condenser and for determining the charging time constant of said first and second condensers;

a bidirectional thyrister whose one end is tied to the other end of said second condenser;

a first transformer whose primary coil is connected to said bidirectional thyrister and for generating a starting pulse converted by said first and second condensers;

a diode and third condenser tied to the secondary coil of said first transformer and for performing rectification;

an auxiliary discharge tube which turns on when the voltage rectified by said diode and third condenser reaches a predetermined voltage; and a second transformer for supplying a starting pulse energy-increased in switching said auxiliary discharge tube to said lamp.

18. A lamp starting apparatus for a liquid crystal projector as claimed in claim 15, wherein said starting and impedance converter comprises:

a first condenser whose one end is connected to said lamp input voltage detector;

a second condenser whose one end is tied to the other end of said first condenser;

a transistor whose collector and emitter are connected to either end of said first condenser and switched according to an externally input signal;

a resistor connected to said lamp input power source and the other end of said second condenser and for determining the charging time constant of said first and second condensers;

a bidirectional thyrister whose one end is tied to the other end of said second condenser;

a coil whose one end is connected to the other end of said bidirectional thyrister;

a relay tied to either end of said coil and switched according to an externally input control signal;

a first transformer whose primary coil is connected to the other end of said coil and for generating a starting pulse converted by said first and second condensers and coil;

a diode and third condenser tied to the secondary coil of said transformer and for performing rectification;

an auxiliary discharge tube which turns on when the voltage rectified by said diode and third condenser reaches a predetermined voltage; and a second transformer for supplying a starting pulse energy-increased in switching said auxiliary discharge tube.

19. A lamp starting apparatus for a liquid crystal projector comprising:

a lamp;

a timing generator for generating a timing signal to start a lamp; and a starting and impedance converter including a device for increasing the number of starting pulses applied to both electrodes of the lamp according to a timing signal from the timing generator, said converter being connected to one end of the timing generator, wherein the number of pulses generated by the starting and impedance converter increases during continuous restart of the lamp within a set period of time.

20. A lamp starting apparatus for a liquid crystal projector comprising:

a timing generator for generating a timing signal to start a lamp;

a starting and impedance converter for converting a starting pulse applied to both electrodes of the lamp, wherein the number of pulses generated by the starting and impedance converter increases during continuous restart of the lamp within a set period of time; and a lamp input voltage detecting and controlling portion for detecting an input voltage applied to both electrodes of the lamp and for supplying signals which operate the starting/impedance converter and signals which stop the operation of the starting and impedance converter by detecting a voltage drop due to negative resistance characteristics of the lamp at the completion of the starting of the lamp.

* * * * *